US008270882B2

(12) United States Patent
Mihara et al.

(10) Patent No.: US 8,270,882 B2
(45) **Date of Patent: *Sep. 18, 2012**

(54) DEVELOPING DEVICE AND IMAGE FORMING APPARATUS USING THE SAME

(75) Inventors: Koichi Mihara, Osaka (JP); Yasuyuki Ishiguro, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 346 days.

This patent is subject to a terminal disclaimer.

(21) Appl. No.: 12/693,723

(22) Filed: Jan. 26, 2010

(65) Prior Publication Data

US 2010/0196058 A1 Aug. 5, 2010

(30) Foreign Application Priority Data

Feb. 2, 2009 (JP) ..... 2009-21451

(51) Int. Cl.
*G03G 15/08* (2006.01)

(52) U.S. Cl. ..... 399/256

(58) Field of Classification Search ..... 399/254, 399/256

See application file for complete search history.

(56) References Cited

U.S. PATENT DOCUMENTS

| | | | | |
|---|---|---|---|---|
| 7,035,573 | B2 | 4/2006 | Yamaguchi et al. | |
| 7,979,007 | B2 * | 7/2011 | Mihara et al. | 399/254 |
| 8,045,896 | B2 * | 10/2011 | Mihara | 399/254 |
| 2004/0057755 | A1 | 3/2004 | Yamaguchi et al. | |
| 2008/0025763 | A1 | 1/2008 | Suenami | |

FOREIGN PATENT DOCUMENTS

| | | | |
|---|---|---|---|
| CN | 2408120 | Y | 11/2000 |
| JP | 2004-151326 | A | 5/2004 |
| JP | 2004-258237 | A | 9/2004 |
| JP | 2005-024592 | A | 1/2005 |
| JP | 2005-078013 | A | 3/2005 |

* cited by examiner

*Primary Examiner* — David Gray
*Assistant Examiner* — Gregory H Curran
(74) *Attorney, Agent, or Firm* — Nixon & Vanderhye P.C.

(57) ABSTRACT

In a developing device including a developing vessel for storing a developer, a first conveying passage, a second conveying passage, a first conveying member, a second conveying member and a developing roller, the first conveying member has a first rotary shaft and a first conveying blade formed on the periphery of the first rotary shaft, the first conveying blade has a first inner helical blade formed on the periphery of the first rotary shaft and a first outer helical blade arranged along the axis of the first rotary shaft and radially outside the outer periphery of the first inner helical blade, and the helical pitch of the first outer helical blade is specified to be shorter than the helical pitch of the first inner helical blade.

7 Claims, 8 Drawing Sheets

DEVELOPING DEVICE AND IMAGE FORMING APPARATUS USING THE SAME

This Nonprovisional application claims priority under 35 U.S.C. §119(a) on Patent Application No. 2009-021451 filed in Japan on 2 Feb. 2009, the entire contents of which are hereby incorporated by reference.

BACKGROUND OF THE TECHNOLOGY (1) Field of the Technology

The present technology relates to a developing device and an image forming apparatus using the device, in particular relating to a developing device using a dual-component developer containing a toner and a magnetic carrier, for use in an image forming apparatus for forming images using the toner based on electrophotography, such as an electrostatic copier, laser printer, facsimile machine or the like, as well as to an image forming apparatus using this device.

(2) Description of the Prior Art

Conventionally, image forming apparatuses based on electrophotography such as copiers, printers, facsimile machines and the like have been known. The image forming apparatus using electrophotography is constructed so as to form an image by forming an electrostatic latent image on the photoreceptor drum (toner image bearer) surface, supplying toner to the photoreceptor drum from a developing device to develop the electrostatic latent image, transferring the toner image formed on photoreceptor drum by development to a sheet of paper or the like, and fixing the toner image onto the sheet by means of a fixing device.

Recently, in the image forming apparatuses capable of reproducing full-color and high-quality images, a dual-component developer (which will be referred to hereinbelow as simply "developer"), which can present excellent charge performance stability, is often used. This developer consists of a toner and a carrier, which are agitated in the developing device and frictionally rubbed with each other to produce appropriately electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, the image forming apparatus of this kind is demanded to be made compact and operate at high speeds, and it is also necessary to electrify the developer quickly and sufficiently and also convey the developer quickly and smoothly.

For this purpose, in order to disperse supplied toner promptly into the developer and provide the toner with an appropriate amount of charge, an image forming apparatus equipped with a developing device of a circulating mechanism including two developer conveying passages that form a circulative path for conveying the developer and two developer agitators that agitate the developer while conveying the developer in the developer passages has been disclosed in patent document 1 (see Japanese Patent Application Laid-open 2005-24592).

In the developing device of patent document 1, usually, auger screws are used as the conveying members for circulatively conveying the developer while agitating the developer inside the developer vessel. However, this configuration has suffered the problem that if the rotational speed of the augers is increased in order to raise the speed of developer conveyance, the developer would clump and stick to the interior wall of the developer vessel due to frictional heat generated between the developer and the interior wall of the developer vessel that encloses the auger screws, spoiling the flow of the developer. As a result, there occurs the problem that the developer's conveyance (agitation) performance is degraded, causing background fogging and image density unevenness due to toner's failure in getting the necessary static charge.

SUMMARY OF THE TECHNOLOGY

The present technology has been devised in view of the above problems, it is therefore an object of the present technology to provide a developing device that can prevent the developer from clumping and sticking to the interior wall of the developer vessel without degrading conveyance performance as well as providing an image forming apparatus using this device.

According to the present technology, the developing device for solving the above problems and the image forming apparatus using this are configured as follows:

The developing device according to the first aspect of the present technology includes: a developer container for storing a developer comprising a toner and a magnetic carrier; a developer conveying passage through which the developer is conveyed in the developer container; a developer conveying member disposed inside the developer conveying passage for agitating and conveying the developer in a predetermined direction; and, a developing roller which supports the developer in the developer conveying passage and supplies the toner contained in the developer to a photoreceptor drum, and is characterized in that the developer conveying member includes: a rotary shaft; and a plurality of helical blades provided on the periphery of the rotary shaft, the plural helical blades being composed of a first helical blade formed on the periphery of the rotary shaft and a second helical blade arranged along the axis of the rotary shaft and radially outside the outer periphery of the first helical blade, and the helical pitch of the second helical blade is specified to be shorter than the helical pitch of the first helical blade.

In the present technology, the first helical blade is an inner helical blade whose outer periphery corresponds to the inside diameter of the second helical blade, which is an outer helical blade arranged outside the first helical blade.

According to the second aspect of the present technology, it is preferable that the second helical blade is provided so as to define a ring-shaped form when viewed from the axial direction that inscribes the outer periphery of the first helical blade.

According to the third aspect of the present technology, it is preferable that the helical pitch of the second helical blade is set to fall within the range of 0.4 times to 0.6 times of the helical pitch of the first helical blade.

According to the fourth aspect of the present technology, it is preferable that the first helical blade has a multi-helix structure made of a plurality of helical blades.

According to the fifth aspect of the present technology, it is preferable that the outside diameter of the first helical blade is set to fall within the range of 0.7 times to 0.8 times of the outside diameter of the second helical blade.

According to the sixth aspect of the present technology, it is preferable that the developer conveying member is formed so that the helix angle formed between the second helical blade and the axis of the rotary shaft falls within the range of 60° to 80°.

Further, the image forming apparatus according to the seventh aspect of the present technology resides in an image forming apparatus for forming images with toner based on electrophotography, comprising: a photoreceptor drum for forming an electrostatic latent image on the surface thereof; a charging device for electrifying the surface of the photoreceptor drum; an exposure device for forming the electrostatic latent image on the photoreceptor drum surface; a developing device for forming a toner image by supplying toner to the electrostatic latent image on the photoreceptor drum surface; a transfer device for transferring the toner image on the photoreceptor drum surface to a recording medium; and, a fixing device for fixing the toner image to the recording medium, wherein the developing device employs any one of the developing devices of the first to sixth aspects.

According to the first aspect of the present technology, the conveying speed of the developer thrust along the axial direction (developer conveying direction) of the rotary shaft during one revolution of the developer conveying member is higher in the vicinity of the rotary shaft and lower in the vicinity of the interior wall of the developer conveying passage. As a result, the frictional force generated between the developer and the interior wall of the developer conveying passage is alleviated, so that it is possible to inhibit the developer from clumping and sticking to the interior wall due to frictional heat even in the case where the developer is conveyed by rotating the developer conveying member at high speeds.

According to the second aspect of the present technology, it is possible for the second helical blade to convey the developer around the periphery of the first helical blade without degrading the developer conveying operation of the first helical blade.

According to the third aspect of the present technology, both agitation performance and conveyance performance of the distinct helical blades can be made compatible, thus making it possible to stabilize the flow of the developer.

Here, if the helical pitch of the second helical blade is less than 0.4 times of the helical pitch of the first helical blade, there occurs a large difference in the speed of the developer being conveyed, causing strong agitation of the developer. As a result, the fluidity of the developer is prone to lower due to stress on the developer. In contrast, if the helical pitch of the second helical blade exceeds 0.6 times of the helical pitch of the first helical blade, the developer becomes prone to clump and stick to the interior wall of the developer conveying passage due to frictional heat generated between the developer and the interior wall of the developer conveying passage, in the case where the developer is conveyed by rotating the developer conveying member at high speeds.

According to the fourth aspect of the present technology, since the force (pressure) acting on the developer during rotation of the developer conveying member can be reduced by making the interval between adjacent helical blades short, it is possible to alleviate degradation of the fluidity due to stress on the developer.

That is, since the longer the helical pitch of the helical blade is, the greater the amount of the developer between adjacent helical blades is collected, the force (pressure) acting on the developer becomes greater, increasing stress on the developer. However, according to the present technology, use of a multi-helix structure makes the interval between adjacent helical blades short, hence reducing the amount of the developer between adjacent helical blades. As a result, it is possible to reduce the force (pressure) acting on the developer during rotation of the developer conveying member, hence alleviate degradation of the fluidity due to stress on the developer.

According to the fifth aspect of the present technology, both agitation performance and conveyance performance of the distinct helical blades can be made compatible, thus making it possible to stabilize the flow of the developer.

Here, if the outside diameter of the first helical blade is less than 0.7 times of the second helical blade, it is necessary to raise the rotational speed of the developer conveying member in order to enhance the speed of developer conveyance, hence the developer becomes prone to clump and stick to the interior wall of the developer conveying passage due to frictional heat generated between the developer and the interior wall of the developer conveying passage. In contrast, if the outside diameter of the first helical blade exceeds 0.8 times of the outside diameter of second helical blade, the developer conveying speed in the vicinity of the interior wall of the developer vessel cannot be effectively lowered in the case where the developer is conveyed by rotating the developer conveying member at high speeds.

According to the sixth aspect of the present technology, since, of the force the developer receives from the second helical blade, the component in the direction of the axis of the rotary shaft (in the developer conveying direction) can be made greater than the rotational component, it is possible to reduce the friction arising when the developer comes in contact with the interior wall and the second helical blade without lowering the developer conveying speed.

Here, if the helix angle formed between the second helical blade and the axis of the rotary shaft is less than 60°, the rotational component of the force becomes large while the developer is moved greatly in the developer's direction of conveyance, hence the friction between the developer and the interior wall of the developer conveying passage becomes large. As a result, the developer becomes prone to clump and stick to the interior wall of the developer conveying passage. In contrast, if the helix angle formed between the second helical blade and the axis of the rotary shaft exceeds 80°, it is necessary to raise the rotational speed of the developer conveying member in order to enhance the developer conveying speed, hence the developer becomes prone to clump and stick to the developing conveying member due to frictional heat generated between the developer and the developer conveying member.

According to the seventh aspect of the present technology, since it is possible to inhibit the developer from clumping and sticking to the interior wall of the developer conveying passage due to frictional heat generated between the developer and the interior wall of the developer conveying passage even when the developer is conveyed by rotating the developer conveying member at high speeds, it is possible to alleviate toner's failure in getting the necessary static charge and image density unevenness due to undesirable developer conveyance.

DESCRIPTION OF THE PREFERRED EMBODIMENTS

The First Embodiment

Now, the embodied modes for carrying out the present technology will be described with reference to the drawings.

Figure 1:
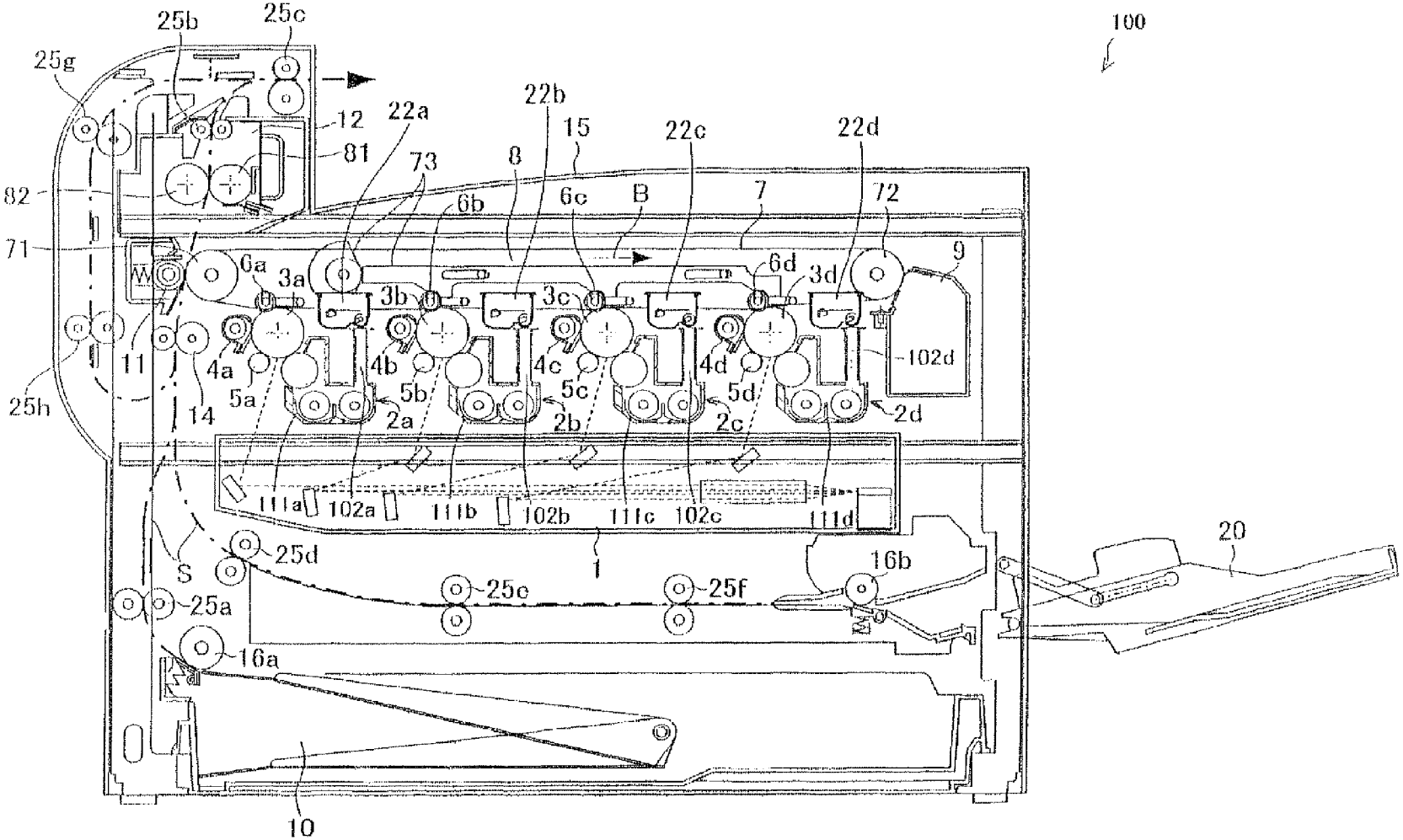
FIG. 1 is an illustrative view showing the overall configuration of an image forming apparatus including a developing device according to the first embodiment of the present technology.

FIG. 1 shows one exemplary embodiment of the present technology, and is an illustrative view showing the overall configuration of an image forming apparatus including a developing device according to the first embodiment of the present technology.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surface thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimpose these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Arranged over developing devices 2 (2*a*, 2*b*, 2*c* and 2*d*) are toner transport mechanisms 102*a*, 102*b*, 102*c* and 102*d* (which may also be called "toner transport mechanisms 102 when general mention is made), toner supply devices 22 (22*a*, 22*b*, 22*c* and 22*d*) and developing vessels (developer container) 111*a*, 111*b*, 111*c* and 111*d* (which may also be called "developer vessels 111 when general mention is made).

Toner supply device 22 is arranged on the upper side of developing vessel 111 and stores unused toner (powder toner). This unused toner in toner supply device 22 is supplied to developing vessel 111 by means of toner transport mechanism 102.

Cleaner unit 4 removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6*a*, 6*b*, 6*c* and 6*d* (which may also be called "intermediate transfer rollers 6 when general mention is made), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc., coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes in contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the area where this cleaning blade comes into contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a controller (not shown) so as to keep a predetermined fixing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (a single color toner image) fixed thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 of the first embodiment will be specifically described.

Figure 2:
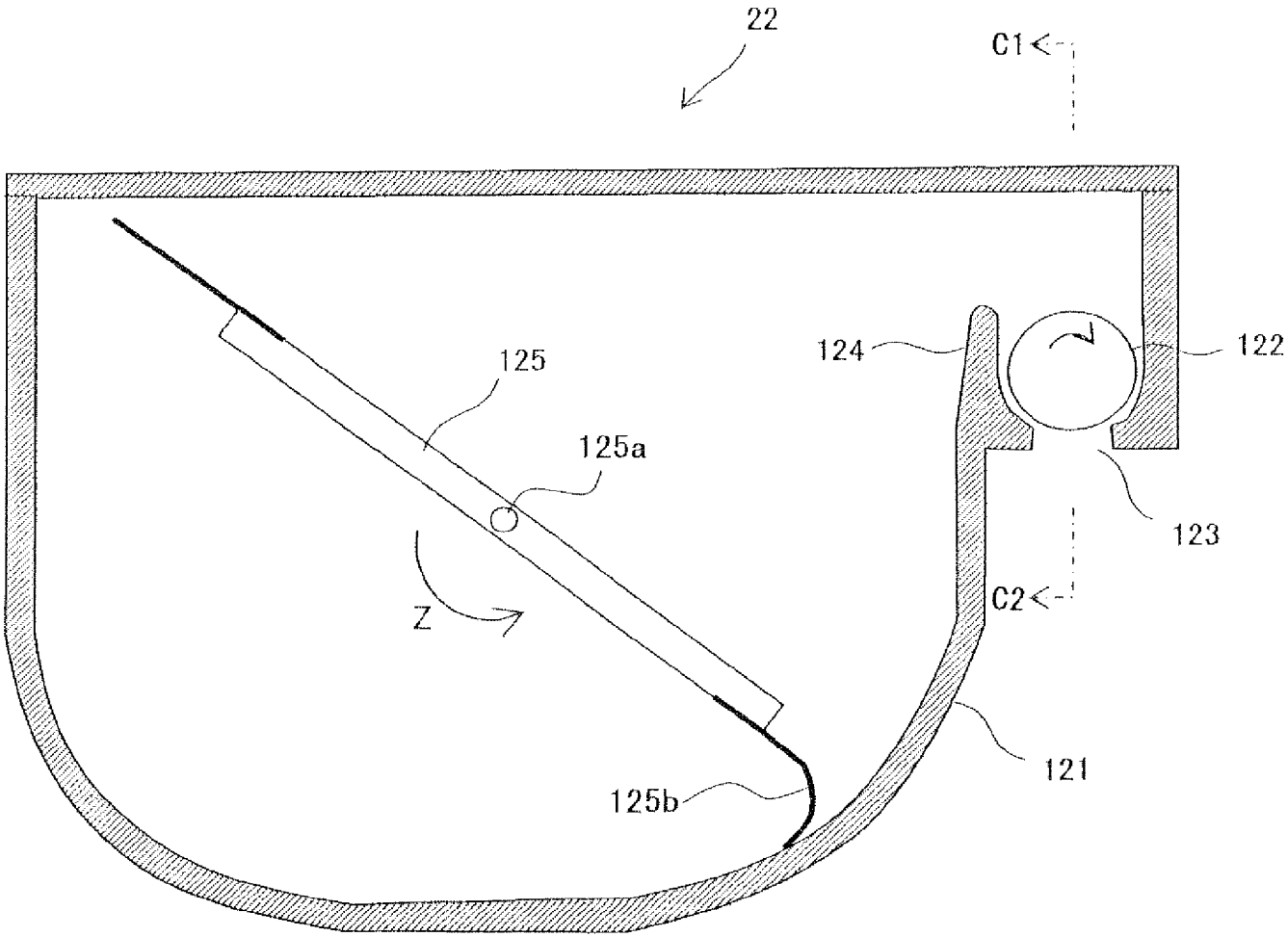
FIG. 2 is a sectional view showing the schematic configuration of a toner supply device that constitutes the image forming apparatus.
Figure 3:
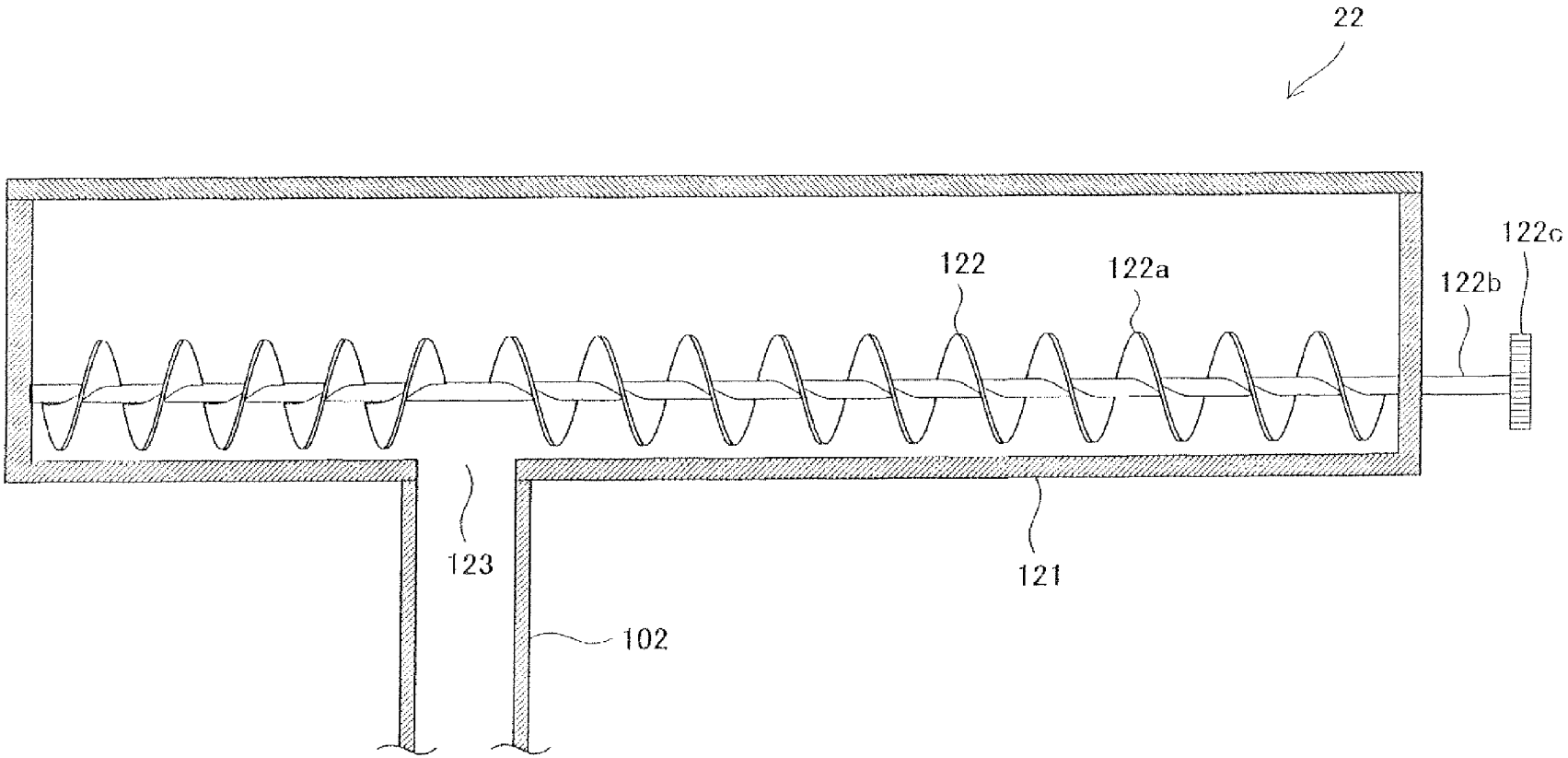
FIG. 3 is a sectional view cut along a plane C1-C2 in FIG. 2.

FIG. 2 is a sectional view showing the schematic configuration of the toner supply device that constitutes the image forming apparatus according to the first embodiment. FIG. 3 is a sectional view cut along a plane C1-C2 in FIG. 2.

As shown in FIG. 2, toner supply device 22 includes a toner storing container 121, a toner agitator 125, a toner discharger 122 and a toner discharge port 123. Toner supply device 22 is arranged on the upper side of developing vessel 111 and stores unused toner (powder toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part having a substantially semicylindrical configuration with a hollow interior, rotationally supporting toner agitator 125 and toner discharger 122 to store toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* in the direction of arrow Z as shown in FIG. 2 and draws up and conveys the toner stored inside toner storing container 121 toward toner discharger 122 whilst agitating the toner. Toner agitator 125 has a toner scooping part 125*b* at either end and extended along rotary axis 125*a*. Toner scooping part 125*b* is formed of a polyethylene terephthalate (PET) sheet having flexibility and is attached to both ends parallel to rotary axis 125*a* of toner agitator 125.

Toner discharger 122 dispenses the toner in toner storing container 121 from toner discharge port 123 to developing vessel 111, and is formed of an auger screw of a toner conveyor blade 122*a* and a toner discharger rotary shaft 122*b* and a toner discharger rotating gear 122*c*, as shown in FIG. 3. Toner discharger 122 is rotationally driven by an unillustrated toner discharger drive motor. As to the helix direction of the auger screw, toner conveyor blade 122*a* is designed so that toner can be conveyed from both ends of toner discharger 122 toward toner discharge port 123 with respect to the axial direction of toner discharger rotational axis 122*b*.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 agitates and scoop up the toner toward toner agitator 122 by its rotation in the direction of arrow Z, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, developing device 2 will be described with reference to the drawings.

Figure 4:
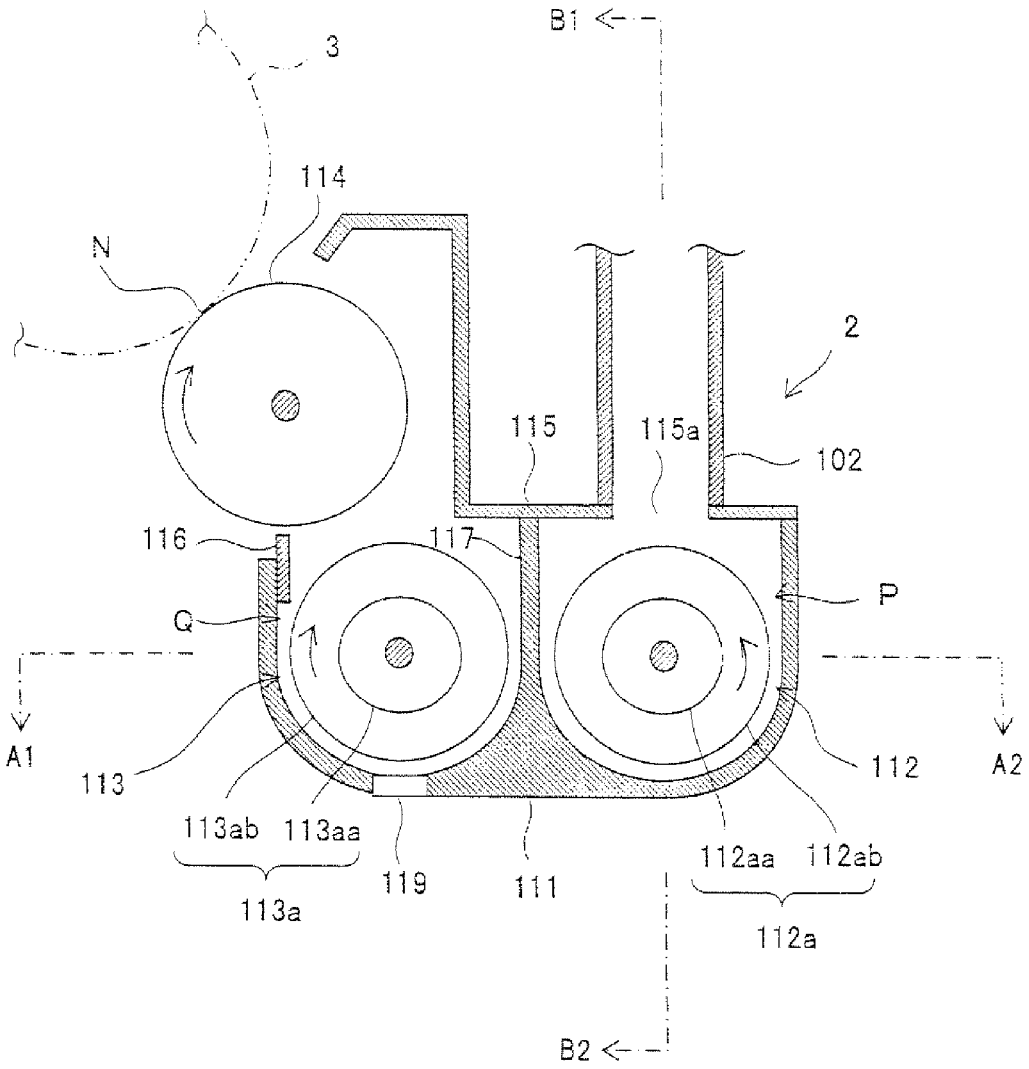
FIG. 4 is a sectional view showing the configuration of a developing device that constitutes the image forming apparatus.
Figure 5:
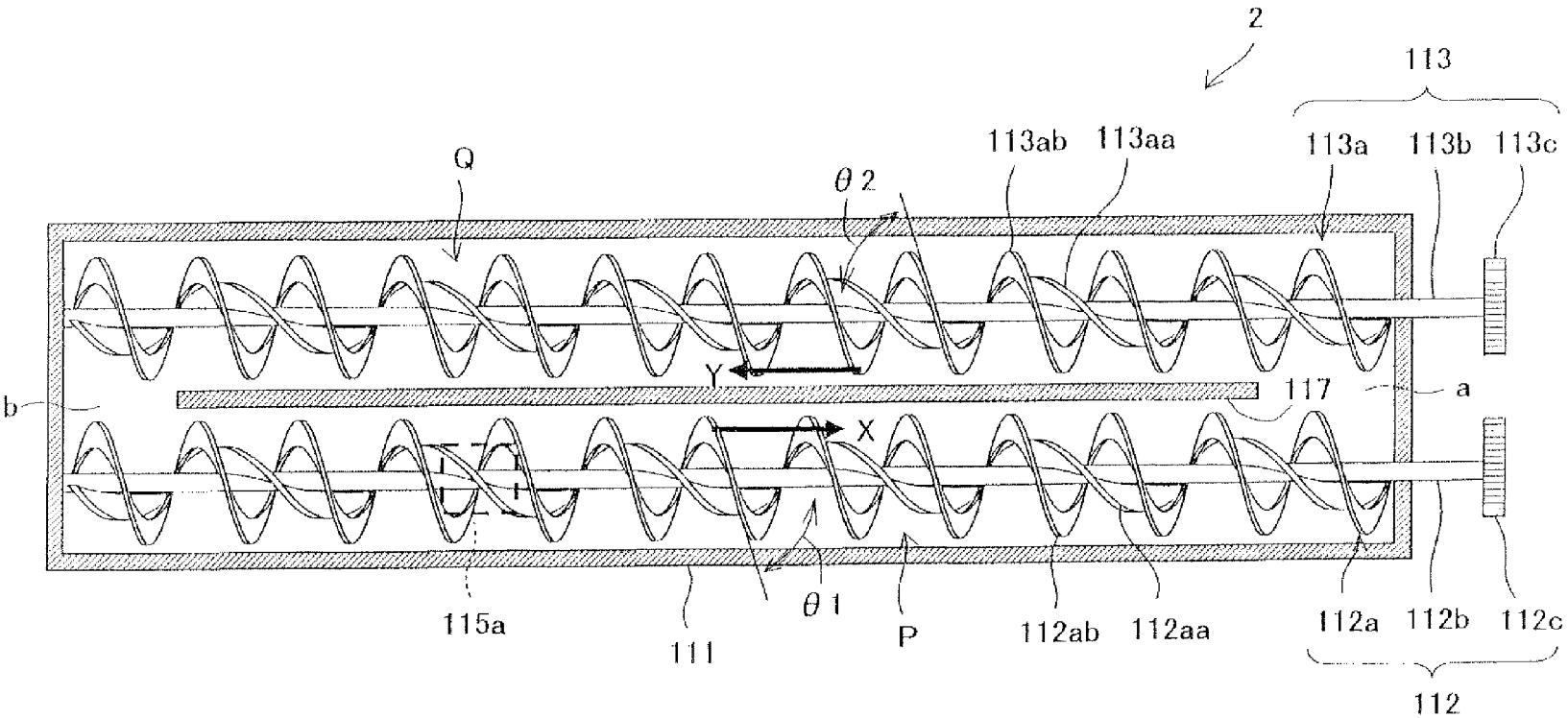
FIG. 5 is a sectional view cut along a plane A1-A2 in FIG. 4.
Figure 6:
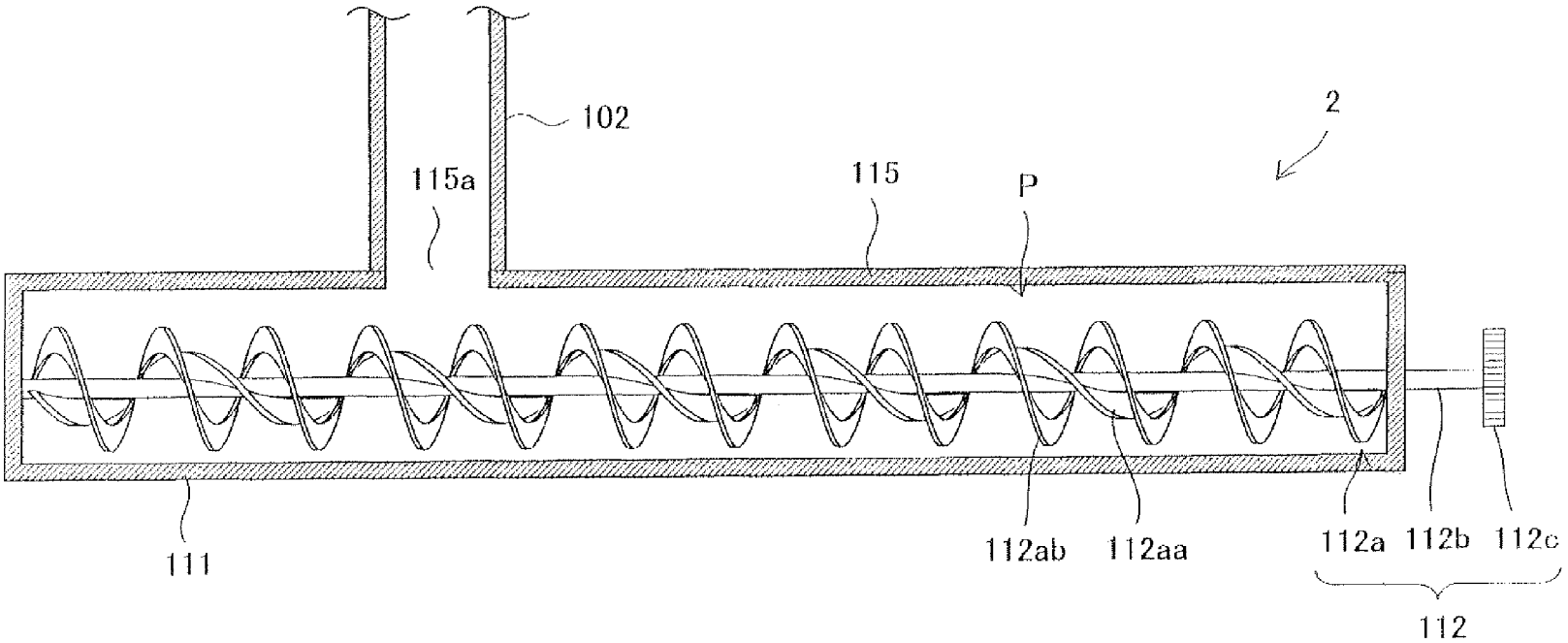
FIG. 6 is a sectional view cut along a plane B1-B2 in FIG. 4.

FIG. 4 is a sectional view showing the configuration of developing device 2, FIG. 5 is a sectional view cut along a plane A1-A2 in FIG. 4, and FIG. 6 is a sectional view cut along a plane B1-B2 in FIG. 4.

As shown in FIG. 4, developing device 2 has a developing roller 114 arranged in developing vessel (developer storing portion) 111 so as to oppose photoreceptor drum 3 and supplies toner from developing roller 114 to the photoreceptor drum 3 surface to visualize (develop) the electrostatic latent image formed on the surface of photoreceptor drum 3.

Developing device 2, other than developing roller 114, further includes developing vessel 111, a developing vessel cover 115, a toner supply port 115*a*, a doctor blade 116, a first conveying member (developer conveying member) 112, a second conveying member (developer conveying member) 113, a partitioning plate (partitioning wall) 117 and a toner concentration detecting sensor (magnetic permeability detecting sensor) 119.

Developing vessel 111 is a container for holding a dual-component developer that contains a toner and a carrier (which will be simply referred to hereinbelow as "developer"). Developing vessel 111 includes developing roller 114, first conveying member 112, second conveying member 113 and the like. Here, the carrier of the first embodiment is a magnetic carrier presenting magnetism.

Developing roller 114 is a rotating magnet roller which is rotationally driven about its axis by an unillustrated means, draws up and carries the developer in developing vessel 111 on the surface thereof and supplies toner from the developer supported on the surface thereof to photoreceptor drum 3.

Developing roller 114 is arranged parallel to, and away from, photoreceptor drum 3, so as to oppose photoreceptor drum 3. The developer conveyed by developing roller 114 comes in contact with photoreceptor drum 3 in the area where the roller surface and the drum surface become closest. This contact area is designated as a developing nip portion N. As a developing bias is applied to developing roller 114 from an unillustrated power source that is connected to developing roller 114, the toner included in the developer on the developing roller 114 surface is supplied at developing nip portion N to the electrostatic latent image on the photoreceptor drum 3 surface.

Arranged close to the surface of developing roller 114 is a doctor blade 116. Doctor blade 116 is a rectangular plate-shaped member that is disposed parallel to the direction in which the axis of developing roller 114 is extended (axial direction). Doctor blade 116 is supported along its one longitudinal side by a developing vessel cover 115 while the opposite longitudinal edge is positioned a predetermined gap away from the developing roller 114 surface. This doctor blade 116 may be made of stainless steel, or may be formed of aluminum, synthetic resin or the like.

Toner concentration detecting sensor 119 is provided on the bottom of developing vessel 111, at a position vertically under second conveying member 113 in the approximate center with respect to the direction of the developer being conveyed, and attached with its sensor surface exposed to the interior of developing vessel 111. Toner concentration detecting sensor 119 is electrically connected to an unillustrated toner concentration controller. This toner concentration controller controls the associated components in accordance with the measurement of toner concentration detected by toner concentration detecting sensor 119 so as to supply toner from toner discharge port 123 into developing vessel 111, by rotationally driving toner discharger 122.

When the toner concentration controller determines that the measurement of toner concentration from toner concentration detecting sensor 119 is lower than the set toner concentration level, the controller sends a control signal to the driver for rotationally driving toner discharger 122, so as to rotationally drive toner discharger 122.

Toner concentration detecting sensor 119 may use general-purpose detection sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. This power supply applies the drive voltage for driving the magnetic permeability detecting sensor and the control voltage for outputting the detected result of toner concentration to the controller. Application of voltage to magnetic permeability detecting sensor from the power supply is controlled by the controller. The magnetic permeability detecting sensor is a sensor that receives application of a control voltage and outputs the detected result of toner concentration as an output voltage. Since, basically, the sensor is sensitive in the middle range of the output voltage, the applied control voltage is adjusted so as to produce an output voltage around that range. Magnetic permeability detecting sensors of this kind are found on the market, examples including TS-L, TS-A and TS-K (all of these are trade names of products of TDK Corporation).

Arranged on the top of developing vessel 111 is removable developing vessel cover 115, as shown in FIG. 4. This developing vessel cover 115 is formed with toner supply port 115*a* for receiving unused toner into developing vessel 111.

Further, as shown in FIG. 1, the toner stored in toner supply device 22 is transported into developing vessel 111 through toner transport mechanism 102 and toner supply port 115*a*, and thereby supplied to developing vessel 111.

Arranged in developing vessel 111 is partitioning plate 117 between first conveying member 112 and second conveying member 113. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 and a second conveying passage Q with second conveying member 113.

Partitioning plate 117 is arranged so that its ends, with respect to the axial direction of first and second conveying members 112 and 113, are spaced from respective interior wall surfaces of developing vessel 111. Hereby, developing vessel 111 has communicating paths that communicate between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged so that their axes are parallel to each other with their peripheral sides opposing each other across partitioning plate 117, and rotated in opposite directions. That is, as shown in FIG. 5, first conveying member 112 conveys the developer in the direction of arrow X while second conveying member 113 conveys the developer in the direction of arrow Y, which is the opposite to the direction of arrow X.

As shown in FIGS. 5 and 6, toner supply port 115*a* is formed within first conveying passage P at a position downstream of second communicating path b with respect to the direction of arrow X. That is, toner is supplied into first conveying passage P at a position downstream of second communicating path b.

In developing vessel 111, first conveying member 112 and second conveying member 113 are rotationally driven by a drive means (not shown) such as a motor etc., to convey the developer.

More specifically, in first conveying passage P, the developer is agitated and conveyed in the direction of arrow X by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y by second conveying member 113 to reach second communicating path b. Then, the developer reaching second communicating path b is conveyed through second communicating path b to first conveying passage P.

That is, first conveying member 112 and second conveying member 113 agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 115*a* into first conveying passage P. The supplied toner is agitated and mixed with the previously existing developer in the first conveying passage P.

Now, first conveying member 112 and second conveying member 113 will be described in detail with reference to the drawings.

As shown in FIG. 5, first conveying member 112 is composed of an auger screw formed of a helical first conveying blade (helical blade) 112*a* and a first rotary shaft 112*b*, and a first conveying gear 112*c*. First conveying member 112 is rotationally driven by a drive means (not shown) such as a motor etc., to agitate and convey the developer.

First conveying blade 112*a* is made up of a first inner helical blade (first helical blade) 112*aa* and a first outer helical blade (second helical blade) 112*ab*.

First inner helical blade 112*aa* is a sheet-like part projectively attached on the periphery of first rotary shaft 112*b* and arranged helically about the longitudinal axis of first rotary shaft 112*b*.

First outer helical blade 112*ab* is a sheet-like part that is kept a predetermined distance away from first rotary shaft 112*b* and arranged so as to curve around, and go along, the axial direction of first rotary shaft 112*b*.

The outside diameter of first outer helical blade 112*ab* is set greater than the outside diameter of first inner helical blade 112*aa*. The inside diameter of first outer helical blade 112*ab* is set equal to the outside diameter of first inner helical blade 112*aa*. First outer helical blade 112*ab* is arranged a predetermined distance away from the periphery of first rotary shaft 112*b* and provided helically in a ring-shaped form when viewed from the axial direction.

The helical pitch of first outer helical blade 112*ab* is set shorter than the helical pitch of first inner helical blade 112*aa*.

The helical pitch of first outer helical blade 112*ab* is preferably specified to fall within the range of 0.4 times to 0.6 times of the helical pitch of first inner helical blade 112*aa*. In the first embodiment, the helical pitch of first outer helical blade 112*ab* is formed to be 0.5 times of the helical pitch of first inner helical blade 112*aa*.

Here, if the helical pitch of first outer helical blade 112*ab* is less than 0.4 times of the helical pitch of first inner helical blade 112*aa*, there occurs a large difference between the speeds of the developer being conveyed by the two blades, causing strong agitation of the developer. As a result, the fluidity of the developer is prone to lower due to stress on the developer. In contrast, if the helical pitch of first outer helical blade 112*ab* exceeds 0.6 times of the helical pitch of first inner helical blade 112*aa*, the developer becomes prone to clump and stick to the interior wall of first conveying passage P due to frictional heat generated between the developer and the interior wall of the first conveying passage P, in the case where the developer is conveyed by rotating first conveying member 112 at high speeds.

Further, the outside diameter of first inner helical blade 112*aa* is preferably specified to fall within the range of 0.7 times to 0.8 times of the outside diameter of first outer helical blade 112*ab*. In the first embodiment, the outside diameter of first inner helical blade 112*aa* is formed to be 0.75 times of the outside diameter of first outer helical blade 112*ab*.

Here, if the outside diameter of first inner helical blade 112*aa* is less than 0.7 times of the outside diameter of first outer helical blade 112*ab*, it is necessary to raise the rotational speed of first conveying member 112 in order to enhance the developer conveying speed, hence the developer becomes prone to clump and stick to the interior wall of first conveying passage P due to frictional heat generated between the developer and the interior wall of the first conveying passage P. In contrast, if the outside diameter of first inner helical blade 112*aa* exceeds 0.8 times of the outside diameter of first outer helical blade 112*ab*, the developer conveying speed in the vicinity of the interior wall of first conveying passage P cannot be effectively lowered in the case where the developer is conveyed by rotating first conveying member 112 at high speeds. As a result, the developer becomes prone to clump and stick to the interior wall of first conveying passage P due to frictional heat generated between the developer and the interior wall of the first conveying passage P.

Moreover, the helix angle θ1 formed between first outer helical blade 112*ab* and the axis of first rotary shaft 112*b* is preferably specified to fall within the range of 60° to 80°. In the first embodiment, the helix angle θ1 formed between first outer helical blade 112*ab* and the axis of first rotary shaft 112*b* is set to be 70°.

Here, if the helix angle θ1 formed between first outer helical blade 112*ab* and the axis of first rotary shaft 112*b* is less than 60°, the rotational component of the force acting on the developer becomes large while the developer is moved greatly in the developer's direction of conveyance, hence the friction between the developer and the interior wall of first conveying passage P becomes large. As a result, the developer becomes prone to clump and stick to the interior wall of first conveying passage P. In contrast, if the helix angle ƒ1 formed between first outer helical blade 112*ab* and the axis of first rotary shaft 112*b* exceeds 80°, it is necessary to raise the rotational speed of first conveying member 112 in order to enhance the developer conveying speed, hence the developer becomes prone to clump and stick to first conveying member 112 due to frictional heat generated between the developer and first conveying member 112.

As shown in FIG. 5, second conveying member 113 is composed of an auger screw formed of a helical second conveying blade (helical blade) 113*a* and a second rotary shaft 113*b*, and a second conveying gear 113*c*. Second conveying member 113 is rotationally driven by a drive means (not shown) such as a motor etc., to agitate and convey the developer.

Second conveying blade 113*a* is made up of a second inner helical blade (first helical blade) 113*aa* and a second outer helical blade (second helical blade) 113*ab*.

Second inner helical blade 113*aa* is a sheet-like part projectively attached on the periphery of second rotary shaft 113*b* and arranged helically about the longitudinal axis of second rotary shaft 113*b*.

Second outer helical blade 113*ab* is a sheet-like part that is kept a predetermined distance away from second rotary shaft 113*b* and arranged so as to curve around, and go along, the axial direction of second rotary shaft 113*b*.

The outside diameter of second outer helical blade 113*ab* is set greater than the outside diameter of second inner helical blade 113*aa*. The inside diameter of second outer helical blade 113*ab* is set equal to the outside diameter of second inner helical blade 113*aa*. Second outer helical blade 113*ab* is arranged a predetermined distance away from the periphery of second rotary shaft 113*b* and provided helically ring-shaped form when viewed from the axial direction.

The helical pitch of second outer helical blade 113*ab* is set shorter than the helical pitch of second inner helical blade 113*aa*.

The helical pitch of second outer helical blade 113*ab* is preferably specified to fall within the range of 0.4 times to 0.6 times of the helical pitch of second inner helical blade 113*aa*. In the first embodiment, the helical pitch of second outer helical blade 113*ab* is formed to be 0.5 times of the helical pitch of second inner helical blade 113*aa*.

Here, if the helical pitch of second outer helical blade 113*ab* is less than 0.4 times of the helical pitch of second inner helical blade 113*aa*, there occurs a large difference between the speeds of the developer being conveyed by the two blades, causing strong agitation of the developer. As a result, the fluidity of the developer is prone to lower due to stress on the developer. In contrast, if the helical pitch of second outer helical blade 113*ab* exceeds 0.6 times of the helical pitch of second inner helical blade 113*aa*, the developer becomes prone to clump and stick to the interior wall of second conveying passage Q due to frictional heat generated between the developer and the interior wall of the second conveying passage Q, in the case where the developer is conveyed by rotating second conveying member 113 at high speeds.

Further, the outside diameter of second inner helical blade 113*aa* is preferably specified to fall within the range of 0.7 times to 0.8 times of the outside diameter of second outer helical blade 113*ab*. In the first embodiment, the outside diameter of second inner helical blade 113*aa* is formed to be 0.75 times of the outside diameter of second outer helical blade 113*ab*.

Here, if the outside diameter of second inner helical blade 113*aa* is less than 0.7 times of the outside diameter of second outer helical blade 113*ab*, it is necessary to raise the rotational speed of second conveying member 113 in order to enhance the developer conveying speed, hence the developer becomes prone to clump and stick to the interior wall of second conveying passage Q due to frictional heat generated between the developer and the interior wall of the second conveying passage Q. In contrast, if the outside diameter of second inner helical blade 113*aa* exceeds 0.8 times of the outside diameter of second outer helical blade 113*ab*, the developer conveying speed in the vicinity of the interior wall of second conveying passage Q cannot be effectively lowered in the case where the developer is conveyed by rotating second conveying member 113 at high speeds. As a result, the developer becomes prone to clump and stick to the interior wall of the developing vessel due to frictional heat generated between the developer and the interior wall of the second conveying passage Q.

Moreover, the helix angle θ2 formed between second outer helical blade 113*ab* and the axis of second rotary shaft 113*b* is preferably specified to fall within the range of 60° to 80°. In the first embodiment, the helix angle θ2 formed between second outer helical blade 113*ab* and the axis of second rotary shaft 113*b* is formed to be 70°.

Here, if the helix angle θ2 formed between second outer helical blade 113*ab* and the axis of second rotary shaft 113*b* is less than 60°, the rotational component of the force acting on the developer becomes large while the developer is moved greatly in the developer's direction of conveyance, hence the friction between the developer and the interior wall of second conveying passage Q becomes large. As a result, the developer becomes prone to clump and stick to the interior wall of second conveying passage Q. In contrast, if the helix angle θ2 formed between second outer helical blade 113*ab* and the axis of second rotary shaft 113*b* exceeds 80°, it is necessary to raise the rotational speed of second conveying member 113 in order to enhance the developer conveying speed, hence the developer becomes prone to clump and stick to second conveying member 113 due to frictional heat generated between the developer and second conveying member 113.

Next, the operation of developing device 2 at the time of conveying the developer will be described with reference to the drawings.

Figure 7:
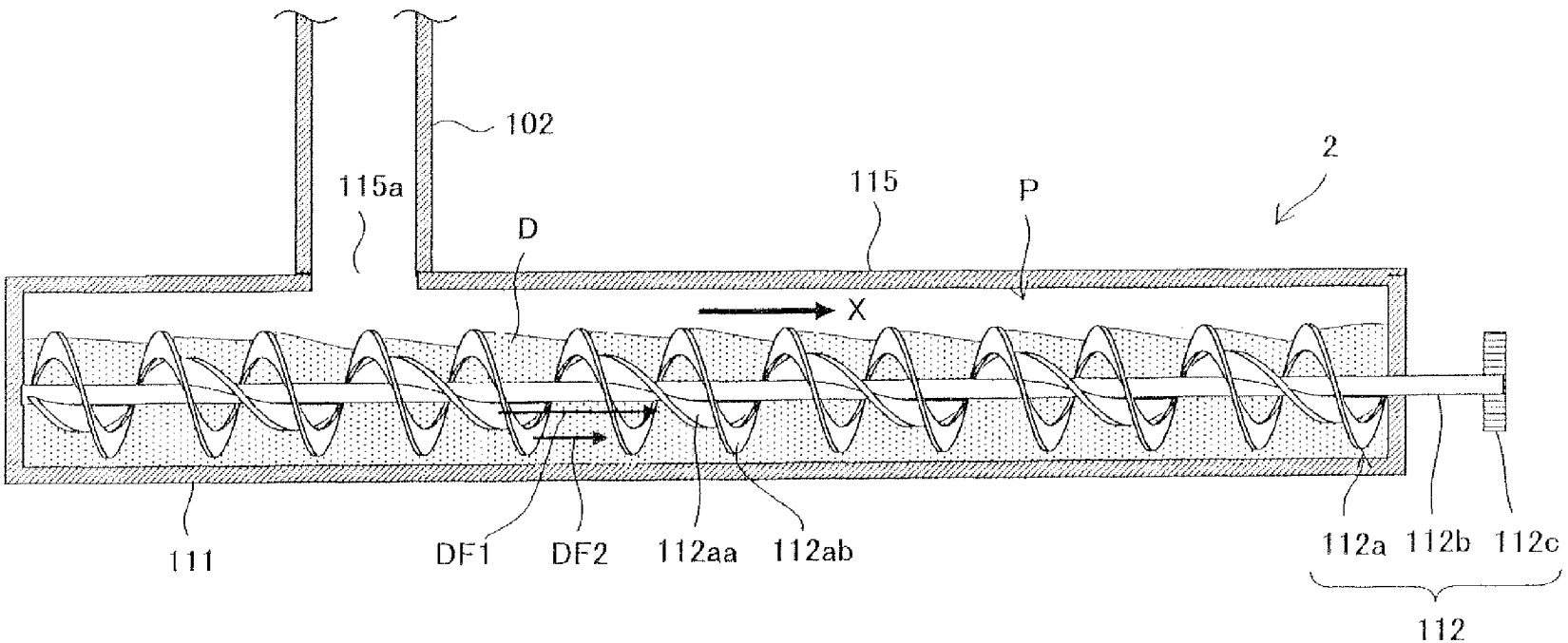
FIG. 7 is an illustrative view showing a state of the developer being conveyed by a first conveying member in the developing device; and, FIG. 8 is a sectional view showing the configuration of a developing device according to the second embodiment of the present technology.

FIG. 7 is an illustrative view showing the state of the developer being conveyed by first conveying member 112 in developing device 2 according to the first embodiment.

According to developing device 2 of the first embodiment, as shown in FIG. 5 the developer in developing vessel 111 is conveyed by first and second conveying members 112 and 113, in the direction of arrow X in first conveying passage P and in the direction of arrow Y in the second conveying passage Q.

The condition of developer D being agitated and conveyed by first and second conveying members 112 and 113 will be described taking the example of first conveying member 112.

As shown in FIG. 7, developer D is agitated and conveyed inside first conveying passage P by rotation of first conveying member 112. Developer D, as receiving force oriented in the direction of arrow X from first inner helical blade 112*aa* and first outer helical blade 112*ab*, is conveyed rightward in the drawing.

In this conveyance, since the helical pitch of first outer helical blade 112*ab* is specified to be 0.5 times of the helical pitch of first inner helical blade 112*aa*, there occurs a difference in the conveying speed of developer D between first inner helical blade 112*aa* and first outer helical blade 112*ab*.

More explicitly, when the conveying speed of the developer D that is thrust by first inner helical blade 112*aa* having a greater helical blade pitch, or the developer D close to rotary shaft 112*b* of first conveying member 112, is named DF1, and the conveying speed of the developer D that is thrust by first outer helical blade 112*ab* having a shorter helical blade pitch, or the developer D close to the interior wall of first conveying passage P, is named DF2, conveying speed DF1 is greater than conveying speed DF2. As a result, the friction between developer D and the interior wall of first conveying passage P is alleviated, so that it is possible to inhibit generation of frictional heat.

Though description was made taking the operational example of first conveying member 112 conveying the developer, the operation of second conveying member 113 is the same as that of first conveying member 112 because second conveying member 113 has the same configuration as first conveying member 112. Accordingly, provision of second conveying member 113 reduces the friction between developer D and the interior wall of second conveying passage Q, so that it is possible to inhibit generation of frictional heat.

According to the first embodiment having the configuration described above, provision of first conveying member 112 and second conveying member 113 in developing device 2 produces a difference in the conveying speed between the developer around the rotary shafts of first and second conveying members 112 and 113 and the developer in the areas close to the interior walls of first and second conveying passages P and Q. Specifically, the conveying speed of developer D in the vicinity of the interior walls of first and second conveying passages P and Q becomes lower than the conveying speed of developer close to the rotational shafts, it is hence possible to reduce friction between developer D and the interior walls of the developer conveying passages, hence inhibit generation of frictional heat. As a result, it is possible to inhibit developer D from clumping and sticking to the interior walls of first and second conveying passages P and Q without degrading conveyance performance of developer D, hence reduce toner's failure in getting proper static charge and image density unevenness due to failures of developer conveyance.

The Second Embodiment

Figure 8:
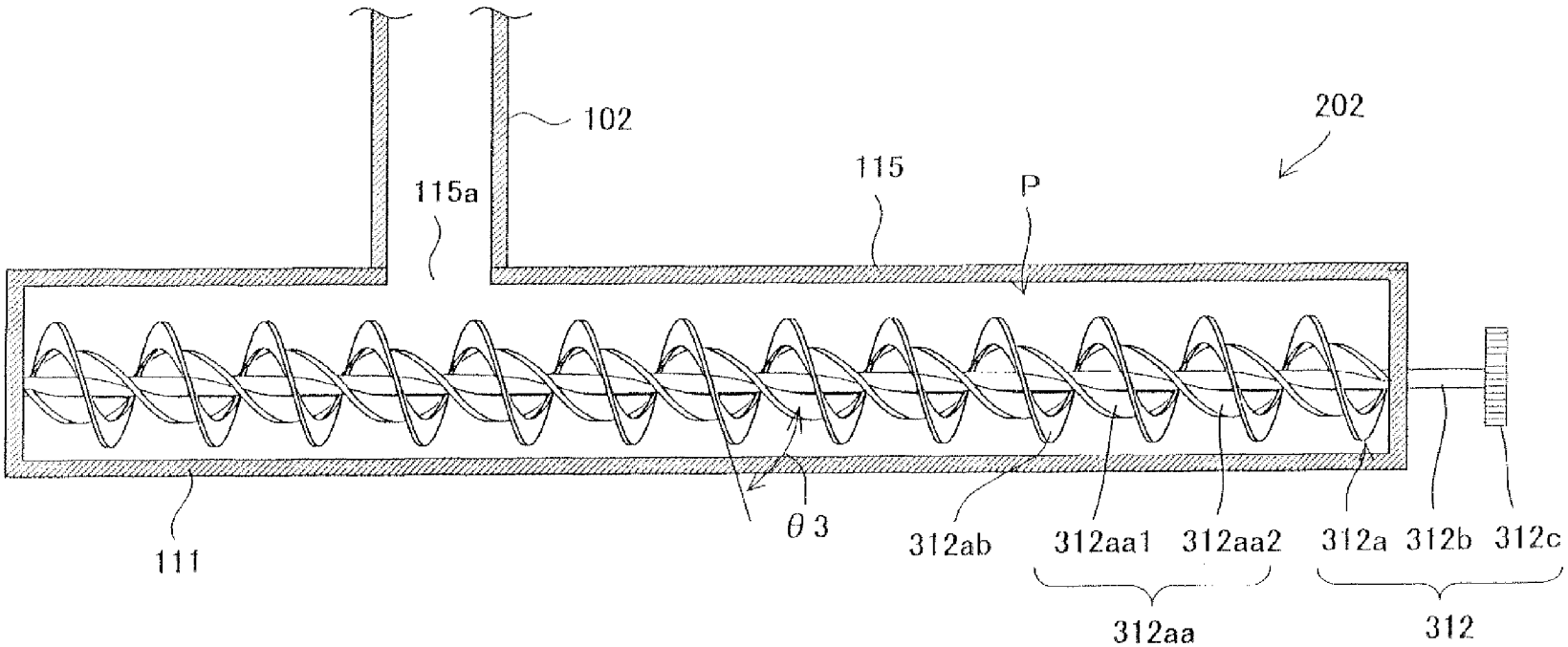

Next, a developing device 202 according to the second embodiment of the present technology will be described with reference to the drawings. FIG. 8 is a sectional view showing the configuration of developing device 202.

Since developing device 202 has the same configuration as that of developing device 2 in the first embodiment except in that a first conveying blade 312*a* of a first conveying member 312 that corresponds to first conveying member 112 in developing device 2 of the above-described first embodiment has a multi-helix structure made of plural helical blades, the components having the same configurations as in developing device 2 will be allotted with the same reference numerals and description on these is omitted.

As shown in FIGS. 8 and 4, developing device 202 includes a first conveying member 312 other than developing roller 114 as well as developing vessel 111, developing vessel cover 115, toner supply port 115*a*, doctor blade 116, second conveying member 113, partitioning plate (partitioning wall) 117 and toner concentration detecting sensor 119.

First conveying member 312 is composed of an auger screw formed of a helical first conveying blade (helical blade) 312*a* and a first rotary shaft 312*b*, and a first conveying gear 312*c*. First conveying member 312 is rotationally driven by a drive means (not shown) such as a motor etc., to agitate and convey the developer.

First conveying blade 312*a* is made up of a first inner helical blade (first helical blade) 312*aa* formed on the periphery of first rotary shaft 312*b* and a first outer helical blade (second helical blade) 312*ab* defining a ring-shaped form when viewed from the axial direction that has an outside diameter greater than the outside diameter of first inner helical blade 312*aa* and inscribes the outer periphery of first inner helical blade 312*aa*. The helical pitch of first outer helical blade 312*ab* is set shorter than the helical pitch of first inner helical blade 312*aa*.

First inner helical blade 312*aa* has a double helix structure made of two helical blades 312*aa*1 and 312*aa*2 having the same pitch. Helical blades 312*aa*1 and 312*aa*2 are formed on the periphery of first rotary shaft 312*b* and shifted 180° out of phase. Here, in the second embodiment, it has been assumed that first inner helical blade 312*aa* has a double helix structure, but, for example a triple helix structure having three helical blades with the same helical pitch or a quadruple helix structure having four helical blades with the same helical pitch may be used.

As described above, since first conveying blade 312*a* includes first inner helical blade 312*aa* having a multi-helix structure, it is possible to make the second interval between adjacent helical blades (312*aa*1-312*aa*2) of the same phase with respect to the longitudinal direction of first rotary shaft 312*b* shorter than the first interval between adjacent helical blades (112*aa*-112*aa*) of the same phase with respect to the longitudinal direction of first rotary shaft 112*b* of first inner helical blade 112*aa* of the first embodiment. Accordingly, a lower amount of developer will be held within the second interval than the amount of developer within the first interval. As a result, the force (pressure) acting on the developer during rotation of first conveying member 312 can be reduced, hence it is possible to alleviate degradation of the fluidity due to stress on the developer.

The helical pitch of first outer helical blade 312*ab* is preferably specified to fall within the range of 0.4 times to 0.6 times of the helical pitch of first inner helical blade 312*aa*. In this embodiment, the helical pitch of first outer helical blade 312*ab* is formed to be 0.5 times of the helical pitch of first inner helical blade 312*aa*.

Here, if the helical pitch of first outer helical blade 312*ab* is less than 0.4 times of the helical pitch of first inner helical blade 312*aa*, there occurs a large difference between the speeds of the developer being conveyed by the two blades, causing strong agitation of the developer. As a result, the fluidity of the developer is prone to lower due to stress on the developer. In contrast, if the helical pitch of first outer helical blade 312*ab* exceeds 0.6 times of the helical pitch of first inner helical blade 312*aa*, the developer becomes prone to clump and stick to the interior wall of first conveying passage P due to frictional heat generated between the developer and the interior wall of the first conveying passage P, in the case where the developer is conveyed by rotating first conveying member 312 at high speeds.

Further, the outside diameter of first inner helical blade 312*aa* is preferably specified to fall within the range of 0.7 times to 0.8 times of the outside diameter of first outer helical blade 312*ab*. In the second embodiment, the outside diameter of first inner helical blade 312*aa* is formed to be 0.75 times of the outside diameter of first outer helical blade 312*ab*.

Here, if the outside diameter of first inner helical blade 312*aa* is less than 0.7 times of the outside diameter of first outer helical blade 312*ab*, it is necessary to raise the rotational speed of first conveying member 312, hence the developer becomes prone to clump and stick to the interior wall of first conveying passage P due to frictional heat generated between the developer and the interior wall of the first conveying passage P. In contrast, if the outside diameter of first inner helical blade 312*aa* exceeds 0.8 times of the outside diameter of first outer helical blade 312*ab*, the developer conveying speed in the vicinity of the interior wall of first conveying passage P cannot be effectively lowered in the case where the developer is conveyed by rotating first conveying member 312 at high speeds. As a result, the developer becomes prone to clump and stick to the interior wall of first conveying passage P due to frictional heat generated between the developer and the interior wall of the first conveying passage P.

Moreover, the helix angle θ3 formed between first outer helical blade 312*ab* and the axis of first rotary shaft 312*b* is preferably specified to fall within the range of 60° to 80°. In the second embodiment, the helix angle θ3 formed between first outer helical blade 312*ab* and the axis of first rotary shaft 312*b* is set to be 70°.

Here, if the helix angle θ3 formed between first outer helical blade 312*ab* and the axis of first rotary shaft 312*b* is less than 60°, the rotational component of the force acting on the developer becomes large while the developer is moved greatly in the developer's direction of conveyance, hence the friction between the developer and the interior wall of first conveying passage P becomes large. As a result, the developer becomes prone to clump and stick to the interior wall of first conveying passage P. In contrast, if the helix angle θ3 formed between first outer helical blade 312*ab* and the axis of first rotary shaft 312*b* exceeds 80°, it is necessary to raise the rotational speed of first conveying member 312 in order to enhance the developer conveying speed, hence the developer becomes prone to clump and stick to first conveying member 312 due to frictional heat generated between the developer and first conveying member 312.

Second conveying member 113 (FIG. 5) is composed of an auger screw formed of a helical second conveying blade 113*a* and a second rotary shaft 113*b*, and a second conveying gear 113*c*. Second conveying member 113 is rotationally driven by a drive means (not shown) such as a motor etc., to agitate and convey the developer.

Second conveying blade 113*a* is made up of a second inner helical blade 113*aa* formed on the periphery of second rotary shaft 113*b* and a second outer helical blade 113*ab* defining a ring-shaped form when viewed from the axial direction that has an outside diameter greater than the outside diameter of second inner helical blade 113*aa* and inscribes the outer periphery of second inner helical blade 113*aa*. The helical pitch of second outer helical blade 113*ab* is set shorter than the helical pitch of second inner helical blade 113*aa*.

The operation of developer conveyance by developing device 202 of the second embodiment is carried out in the same manner as that of developing device 2 of the first embodiment. That is, the developer in the vicinity of first rotary shaft 312*b* of first conveying member 312 is conveyed at higher speeds while the developer thrust by first outer helical blade 312*ab* having a shorter helical pitch or the developer in the vicinity of the interior wall of first conveying passage P is conveyed slowly. As a result, the friction between the developer and the interior wall of first conveying passage P is alleviated, so that it is possible to inhibit generation of frictional heat.

According to the second embodiment having the configuration described above, use of the multi-helix structure of first inner helical blade 312*aa*, in addition to the effect by the first embodiment, can reduce the force (pressure) acted on the developer by the rotation of first conveying member 312, hence it is possible to further reduce degradation of the fluidity of the developer due to stress on the developer.

Here, it goes without saying that the same operation and effect of first inner helical blade 312*aa* can be obtained by providing the multi-helix structure for second inner helical blade 113*aa* in the second embodiment. Alternatively, it is possible that the second inner helical blade is given in the form of a multi-helix structure while first inner helical blade is given in the form of a single helix structure (112*aa*).

Though the above embodiments were described taking examples in which developing devices 2 and 202 of the present technology are applied to image forming apparatus 100 shown in FIG. 1, as long as it is an image forming apparatus using a developing device in which the developer in developing vessel 111 is conveyed while being agitated by the developer conveying member, the technology can be developed to any other image forming apparatus and the like, not limited to the image forming apparatus and copier described above.

Having described heretofore, the present technology is not limited to the above embodiments, various changes can be made within the scope of the appended claims. That is, any embodied mode obtained by combination of technical means modified as appropriate without departing from the spirit and scope of the present technology should be included in the technical art of the present technology.

What is claimed is:

1. A developing device comprising:

a developer container for storing a developer comprising a toner and a magnetic carrier;

a developer conveying passage through which the developer is conveyed in the developer container;

a developer conveying member disposed inside the developer conveying passage for agitating and conveying the developer in a predetermined direction; and, a developing roller which supports the developer in the developer conveying passage and supplies the toner contained in the developer to a photoreceptor drum;

characterized in that the developer conveying member includes: a rotary shaft;

and a plurality of helical blades provided on the periphery of the rotary shaft, the plural helical blades being composed of a first helical blade formed on the periphery of the rotary shaft and a second helical blade arranged along the axis of the rotary shaft and radially outside the outer periphery of the first helical blade, and the helical pitch of the second helical blade is specified to be shorter than the helical pitch of the first helical blade.

2. The developing device according to claim 1, wherein the second helical blade is provided so as to define a ring-shaped form when viewed from the axial direction such that an inner edge of the second helical blade inscribes the outer periphery of the first helical blade.

3. The developing device according to claim 1, wherein the helical pitch of the second helical blade is set to fall within the range of 0.4 times to 0.6 times of the helical pitch of the first helical blade.

4. The developing device according to claim 1, wherein the first helical blade has a multi-helix structure made of a plurality of helical blades.

5. The developing device according to claim 1, wherein the outside diameter of the first helical blade is set to fall within the range of 0.7 times to 0.8 times of the outside diameter of the second helical blade.

6. The developing device according to claim 1, wherein the developer conveying member is formed so that the helix angle formed between the second helical blade and the axis of the rotary shaft falls within the range of 60° to 80°.

7. An image forming apparatus for forming images with toner based on electrophotography, comprising:

a photoreceptor drum for forming an electrostatic latent image on the surface thereof;

a charging device for electrifying the surface of the photoreceptor drum;

an exposure device for forming the electrostatic latent image on the photoreceptor drum surface;

a developing device for forming a toner image by supplying toner to the electrostatic latent image on the photoreceptor drum surface;

a transfer device for transferring the toner image on the photoreceptor drum surface to a recording medium; and, a fixing device for fixing the toner image to the recording medium, characterized in that the developing device employs the developing device defined in claim 1.

* * * * *